US005769282A

United States Patent [19]

Lane et al.

[11] Patent Number: 5,769,282

[45] Date of Patent: Jun. 23, 1998

[54] PRESSURE GENERATION SYSTEM FOR A CONTAINER

[75] Inventors: Michael L. Lane; Lowell T. Whitney, both of Arvada; Michael D. Gerstenkorn, Golden, all of Colo.

[73] Assignee: Quoin Industrial, Inc., Golden, Colo.

[21] Appl. No.: 631,480

[22] Filed: Apr. 12, 1996

[51] Int. Cl.[6] ..... B67D 5/42

[52] U.S. Cl. ..... 222/386.5; 222/399

[58] Field of Search ..... 222/94, 386.5, 222/399, 1; 206/219; 424/44

[56] References Cited

U.S. PATENT DOCUMENTS

| | | | |
|---|---|---|---|
| 2,932,385 | 4/1960 | Bollmeier et al. . | |
| 3,178,075 | 4/1965 | Riedl et al. . | |
| 3,189,231 | 6/1965 | Kibbel, Jr. et al. . | |
| 3,718,236 | 2/1973 | Reyner et al. . | |
| 4,049,158 | 9/1977 | Lo et al. . | |
| 4,251,032 | 2/1981 | Werding . | |
| 4,360,131 | 11/1982 | Reyner . | |
| 4,373,341 | 2/1983 | Mahaffy et al. . | |
| 4,376,500 | 3/1983 | Banks et al. . | |
| 4,458,811 | 7/1984 | Wilkinson | 206/219 |
| 4,478,044 | 10/1984 | Magid . | |
| 4,491,250 | 1/1985 | Liebermann . | |
| 4,513,884 | 4/1985 | Magid . | |
| 4,674,532 | 6/1987 | Koyanagi . | |
| 4,679,706 | 7/1987 | Magid et al. . | |
| 4,708,167 | 11/1987 | Koyanagi . | |
| 4,785,972 | 11/1988 | LeFevre | 222/386.5 X |
| 4,842,007 | 6/1989 | Kurtz . | |
| 4,917,646 | 4/1990 | Kieves . | |
| 4,919,310 | 4/1990 | Young et al. . | |
| 4,923,095 | 5/1990 | Dorfman . | |
| 5,188,558 | 2/1993 | Barton et al. . | |
| 5,287,961 | 2/1994 | Herran | 206/219 |
| 5,333,763 | 8/1994 | Lane et al. . | |

*Primary Examiner*—Kevin P. Shaver
*Attorney, Agent, or Firm*—Klaas, Law, O'Meara & Malkin, P.C.; Michael A. Goodwin

[57] ABSTRACT

Disclosed is a pressure generation system for a container which includes a pressure pouch having a plurality of compartments containing reactive components of an at least two component gas generation system. The compartments are separated by frangible wall portions which fail or tear in response to increasing volume of an adjacent compartment. The frangible wall portions may each comprise a continuous, integral section of frangible material. The frangible wall portions may all be formed from a single sheet of frangible material or, they may alternatively be formed from a plurality of individual sheets.

20 Claims, 12 Drawing Sheets

PRESSURE GENERATION SYSTEM FOR A CONTAINER

FIELD OF THE INVENTION

The present invention relates generally to self pressurized dispensing devices and methods and, more particularly, to a pressure generating system for use in such dispensing devices.

BACKGROUND OF THE INVENTION

Flowable materials are commonly dispensed from pressurized containers. In many such containers, a gaseous propellent is mixed with the flowable material product, thus providing the motive force to expel the product from the container. One example of such a container is an aerosol can in which a propellant gas is provided to drive a liquid or an atomized gas-liquid mixture product from the container. In such containers, the initial pressure within the container often declines as the product is dispensed.

Although this type of pressurization system works adequately with some products, in many applications it is undesirable to mix the propellant gas with the product being dispensed. Such mixing may result in undesirable reactions between the product and the propellant, thus leading to a degradation of the product.

It is also undesirable to dispense many products with a declining pressure dispensing system. This is particularly true with carbonated liquid products, such as beer. It has been found that successfully dispensing carbonated liquids depends, in part, upon maintaining a predetermined relatively constant pressure differential between the inside of the container and the ambient environment. In a declining pressure dispensing system, this is generally not possible.

To overcome the problems discussed above, one pressurization system has been developed in which an expansible pressure pouch is placed within the product container. The pressure pouch includes a plurality of chemicals contained in a series of compartments within the pouch. When mixed together, the chemicals in the pouch generate gas and pressure, thus expanding the pouch and providing pressure to drive the product from the container. As product is dispensed from the container, the pouch expands, causing more compartments to open. This, in turn, causes the introduction and mixing of more gas-generating chemicals and, thus, the development of more pressure within the container. The expansible pouch, thus provides the dual functions of separating the propellant gas from the product and of maintaining a relatively constant pressure profile within the container. Examples of such expansible pressure pouches are disclosed in U.S. Pat. No. 4,919,310 to Young et al.,; U.S. Pat. No. 4,923,095 to Dorfman et al. and U.S. Pat. No. 5,333,763 to Lane et al., which are hereby specifically incorporated by reference for all that is disclosed therein.

Expansible pressure pouches are commonly formed by juxtaposing two sheets of flexible plastic material. FIGS. 1 and 2 illustrate a prior art pressure pouch 10 which is formed of a first flexible plastic sheet 12 and a second flexible plastic sheet 14, FIG. 2. The pouch 10 contains a large first compartment 16 and a plurality of secondary compartments 17, such as the secondary compartments 18, 20, 22, 24, 26, 28 and 30 as shown. First compartment 16 may contain a quantity 32 of the first component of a two-component gas generating system. The secondary compartments 17 may each contain a quantity 34 of the second component of the two component gas generating system. A triggering device 36, located in the compartment 16, may contain a quantity of the second component of the two-component gas generating system.

Referring to FIG. 2, the pouch first sheet 12 is sealed to the second sheet 14 at a permanent peripheral seam area 38. As can best be seen from FIG. 1, permanent seam area 38 extends around both the upper periphery 39 and the lower periphery 40 of the pouch 10. Referring again to FIG. 1, it can be seen that the compartments 16, 17 are separated from one another by peelable seam areas 41, such as the individual peelable seem areas 42, 44, 46, 48, 50, 52 and 54.

During typical operation of the device described above, the pouch 10 is first inserted into a dispensing container containing a flowable material product to be dispensed. After the container is sealed, the pouch triggering device 36 is activated, causing introduction of the second reactive component housed within the triggering device 36 to mix with the quantity 32 of first reactive component located in the compartment 16. The mixture of the first and second reactive components causes the generation of gas which, in turn, pressurizes the compartment 16 and the container. This pressure is used to force product from the container when it is desired to dispense product from the container.

As product is dispensed from the container, the volume of the compartment 16 increases until the peelable seam 42 is pulled, or peeled, apart. Opening of the seam 42 results in the quantity 34 of the second reactive component housed in the compartment 18 to mix with contents of the compartment 16, thus causing more gas and pressure to be generated. This process continues with the peelable seams 44, 46, 48, 50, 52 and 54 being sequentially peeled apart as more product is dispensed from the container.

To form the pouch 10, the first plastic sheet 12 is first placed on top of the second plastic sheet 14. The sheets are then joined at the permanent seam areas 38 extending along the lower pouch periphery 40. The permanent seams 38 are generally formed by applying heat at a relatively high temperature to the plastic sheets 12, 14 at the areas which are to be permanently seamed.

The peelable seams 41, which may be formed either before or after the formation of the permanent seams 38, are generally formed by applying heat at a relatively lower temperature to the plastic sheets 12, 14 at the areas which are to contain peelable seams. After formation of the peelable seams, the reactive components 32 and 34, as well as the triggering device 36 are inserted into the appropriate compartments. The pouch upper periphery 39 may then be permanently seamed together, in a manner as described above, to completely seal the pouch 10. In this manner, a two-layer pouch 10 may be formed having a permanent seam 38 extending around its periphery 39, 40 and peelable seams 41 defining a series of compartments 17 therein containing reactive chemicals.

The pouch 10, as described above is relatively expensive to manufacture and has been found to present various manufacturing complications. Specifically, the plastic film 12, 14 used in the pouch 10 must be capable of performing several functions. First, its outer surfaces 56, 58, FIG. 2, must be compatible with the product to be dispensed from the container. This means that the outer surfaces must be generally non-reactive with the product and, in the case of food products, that they not impart any appreciable flavor to the product.

In most cases, the film must also be relatively gas-impermeable in order to prevent the pressurizing gases generated within the pouch 10 from migrating into and mixing with the product in the container. The film also must be capable of forming reliable permanent seams, such as the permanent seam 38 previously described.

Another requirement of the film used to form the pouch 10 is that its inner surfaces 60, 62, FIG. 2, must be capable of forming reliable peelable seams, such as the peelable seams 41, FIG. 1, in addition to being capable of forming reliable permanent seams as previously described. For successful operation of the pouch 10, the peelable seams must be formed such that a specific and narrow range of force will cause opening of the peelable seams. If the peelable seams are formed with too much strength, they may, in essence, become permanent seams. If this occurs, the peelable seams may fail to separate or may tear the plastic layers 12, 14 when the pouch is activated, in either case resulting in a defective pouch. If the peelable seams are formed with too little strength, they may open prematurely, possibly leading to premature activation of the pouch 10 or in defective operation.

The strength of the peelable seams is dictated by the temperature, the time of heating and the pressure supplied when making the peelable seams. In order to form satisfactory peelable seems, the manufacturing process must be carefully controlled. In particular, the temperature used to form peelable seams must be held within a very narrow range. This range might, for example be between about 190 and 195 degrees, F. Controlling the temperature within such a narrow range has proven to be difficult, particularly in high-speed manufacturing environments.

The strength of the peelable seams is also, however, dictated by the composition of the plastic layers 12, 14. In order to adequately perform the functions described above, the plastic film 12, 14 is conventionally formed of a multilayer laminate. The film might, for example include an outer layer which is compatible with the product to be dispensed, an inner layer capable of forming both peelable and permanent seams and a middle layer that is relatively gas impermeable. This type of film structure can be relatively expensive. It has also been found that even small irregularities in the film structure often interfere with the delicate peelable seam formation. It has also been found that, even perfectly manufactured seams have a tendency to "creep" or erode by slowly opening over time, thus making storage of manufactured pouches having peelable seams difficult.

Thus, it would be generally desirable to provide an apparatus and method which overcomes these problems associated with flowable product dispensing pressure pouches.

SUMMARY OF THE INVENTION

The present invention is directed to a container pressure generation system which includes a pressure pouch having a plurality of compartments containing reactive components of an at least two component gas generation system. The compartments are sequentially opened to provide additional reactive component as product is dispensed from the container.

The compartments are separated by frangible wall portions which fail in response to the increasing volume of an adjacent compartment. In this manner, peelable seams are eliminated from the pressure pouch, thus allowing the pouch to be formed from relatively simple, low cost plastic films. The elimination of peelable seams also makes the pouch manufacturing process simpler and more reliable.

The frangible wall portions may be formed from a frangible plastic material. To form the frangible wall portions, a relatively thin sheet of plastic may be placed between the pouch outer plastic sheets. A plurality of permanent seams may then be formed between the relatively thin intermediate sheet and alternating inner surfaces of the pouch outer plastic sheets, forming compartments between the seam locations. In order to selectively seam the thin intermediate sheet to only one of the pouch outer plastic sheets at a specific location, a seam blocking material such as an ink, may be printed on the pouch outer plastic sheet inner surfaces at locations which are not to be seamed. Alternatively, other methods of applying a seam blocking material may be used to ensure selective seaming to only one of the pouch outer plastic sheets.

The frangible intermediate sheet is formed of a material selected to have a thickness, tensile strength and elasticity consistent with the amount of failure force desired for the particular pouch application.

In order to reduce elastic stretching of the frangible wall portions prior to failure, the pouch may be designed so that the length of the frangible wall portions is minimized. To accomplish this, the relatively thin intermediate sheet may be seamed to one pouch outer plastic sheet at two consecutive locations at a first site, and then to the other pouch outer plastic sheet at two consecutive locations at a second site and so on. With this configuration, the distance between the first site and the second site will determine the length of the frangible wall portion. Accordingly, the length of the frangible wall portion may be minimized by minimizing the distance between the first and second sites.

As opposed to a single intermediate sheet, the frangible wall portions may be formed from a plurality of discreet plastic sheets attached to the inner surfaces of the pouch outer plastic sheets.

DETAILED DESCRIPTION OF THE INVENTION

Figure 1:
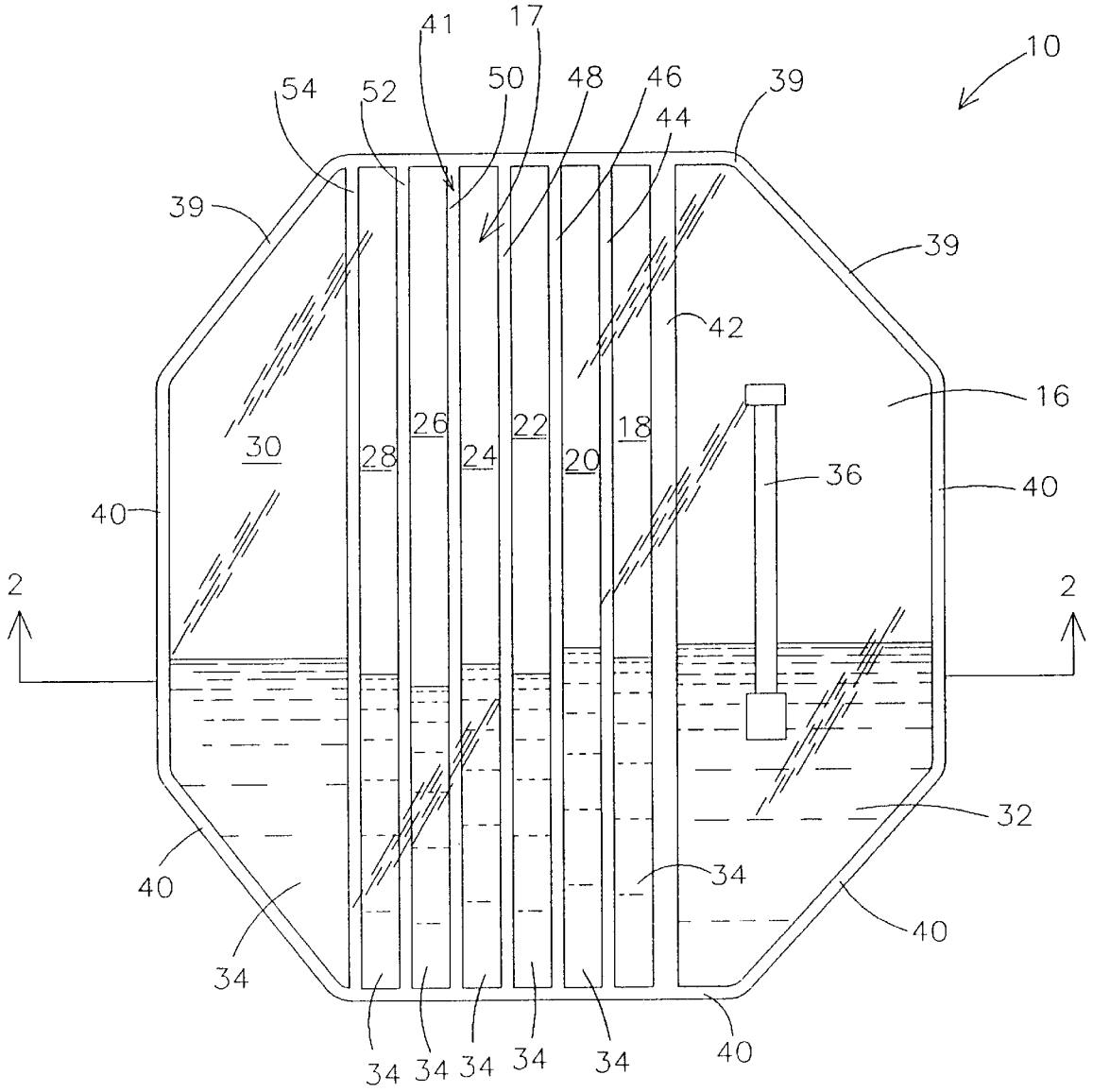
Fig. 1 (PRIOR ART)
FIG. 1 is a top plan view of a pressure pouch according to a prior art design.

FIGS. 3–12, in general, illustrate an improved pressure pouch 100 suited for use in combination with a dispensing container. The pressure pouch 100 may have at least first and second compartments 110, 114 and contain components 130, 132 of an at least two-component gas generating system.

The pouch may include a first sheet 138 of a flexible material having an outer surface 140 and an oppositely disposed inner surface 142; a second sheet 144 of a flexible material having an outer surface 146 and an oppositely disposed inner surface 148; and a third sheet 150 of flexible material located between at least portions of the first and second sheets 138, 144. The third sheet 150 is sealed to the first sheet inner surface 142 at a first location 156 and to the second sheet inner surface 148 at a second location 158 and forms a first divider wall portion 186 located between the first location 156 and the second location 158. The first divider wall portion 186 forms a common wall between the first and second compartments 110, 114.

FIGS. 3–12 also illustrate, in general, an improved pressure system, suited for use in combination with a dispensing container, including a pouch 100 having a first compartment 110 containing at least a first component 130 of an at least two-component gas generating system; a second compartment 114 containing at least a second component 132 of the at least two-component gas generating system; and a first frangible wall portion 186 separating the first and second compartments 110, 114.

FIGS. 3–12 also illustrate, in general, a method of making an improved pressure pouch 100 having at least first and second compartments 110, 114 and containing at least first and second components 130, 132 of an at least two-component gas generating system. The method includes the steps of providing a first sheet 138 of a flexible material having an outer surface 140 and an oppositely disposed inner surface 142; providing a second sheet 144 of a flexible material having an outer surface 146 and an oppositely disposed inner surface 148; locating a third sheet 150 of flexible material between at least portions of the first and second sheets 138, 144; and creating a first divider wall 186 between the first and second compartments 110, 114 by attaching the third sheet 150 to the first sheet inner surface 142 at a first location 156 and to the second sheet inner surface 148 at a second location 158.

Having thus described the pressure generation system in general, the system will now be described in further detail.

Figure 2:
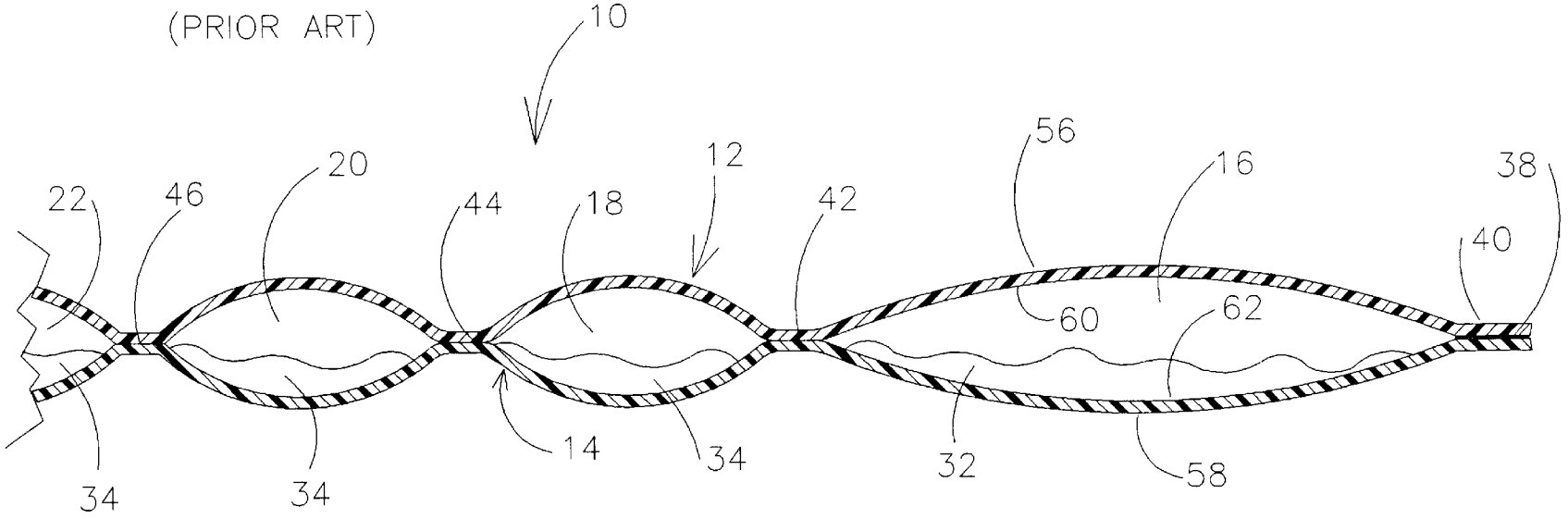
Fig. 2 (PRIOR ART)
FIG. 2 is a cut-away cross-sectional view of the pressure pouch of FIG. 1 taken along the line 2—2 in FIG. 1.
Figure 3:
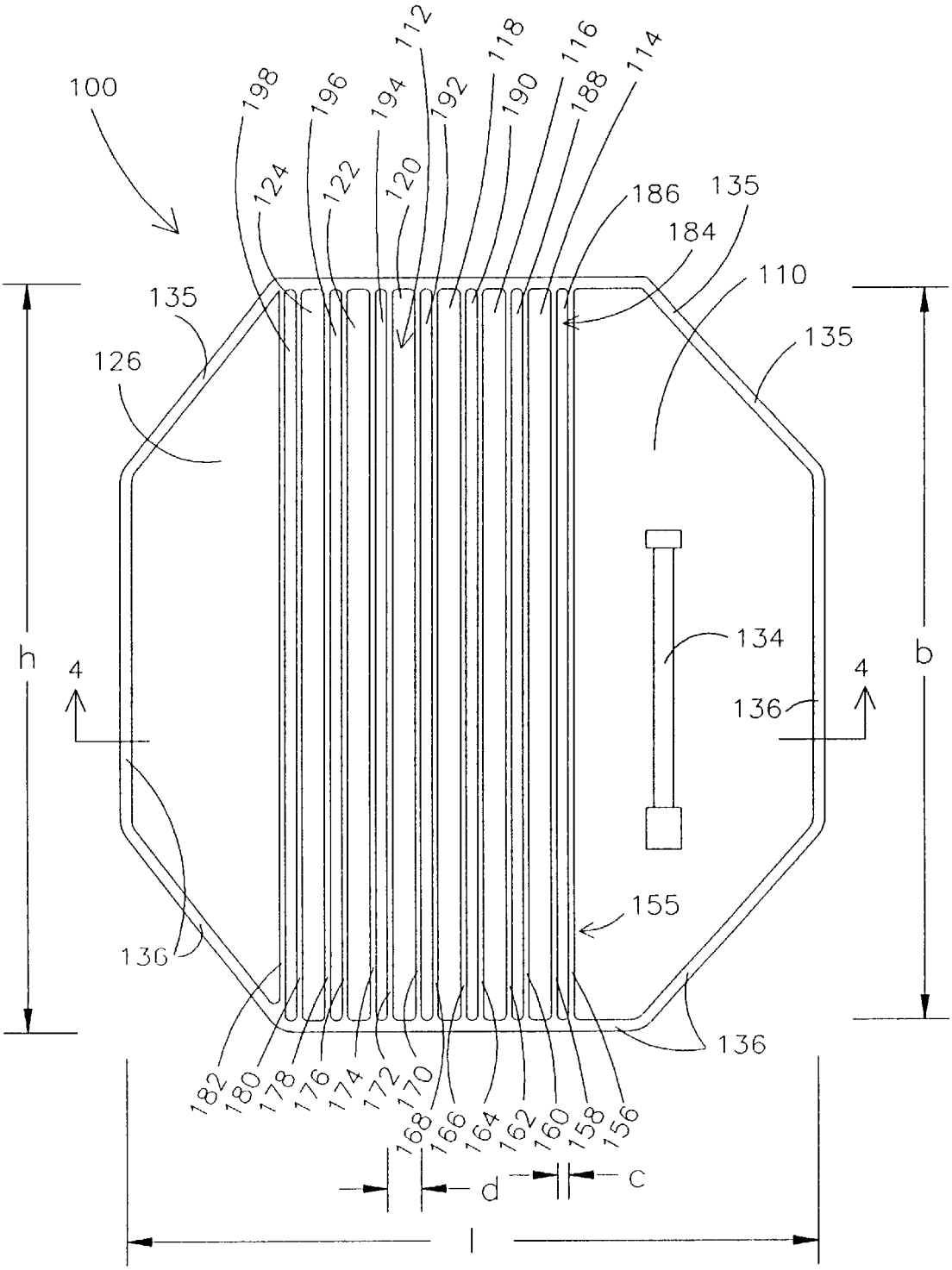
FIG. 3 is a top plan view of a pressure pouch having frangible divider walls, shown in a collapsed configuration.
Figure 4:
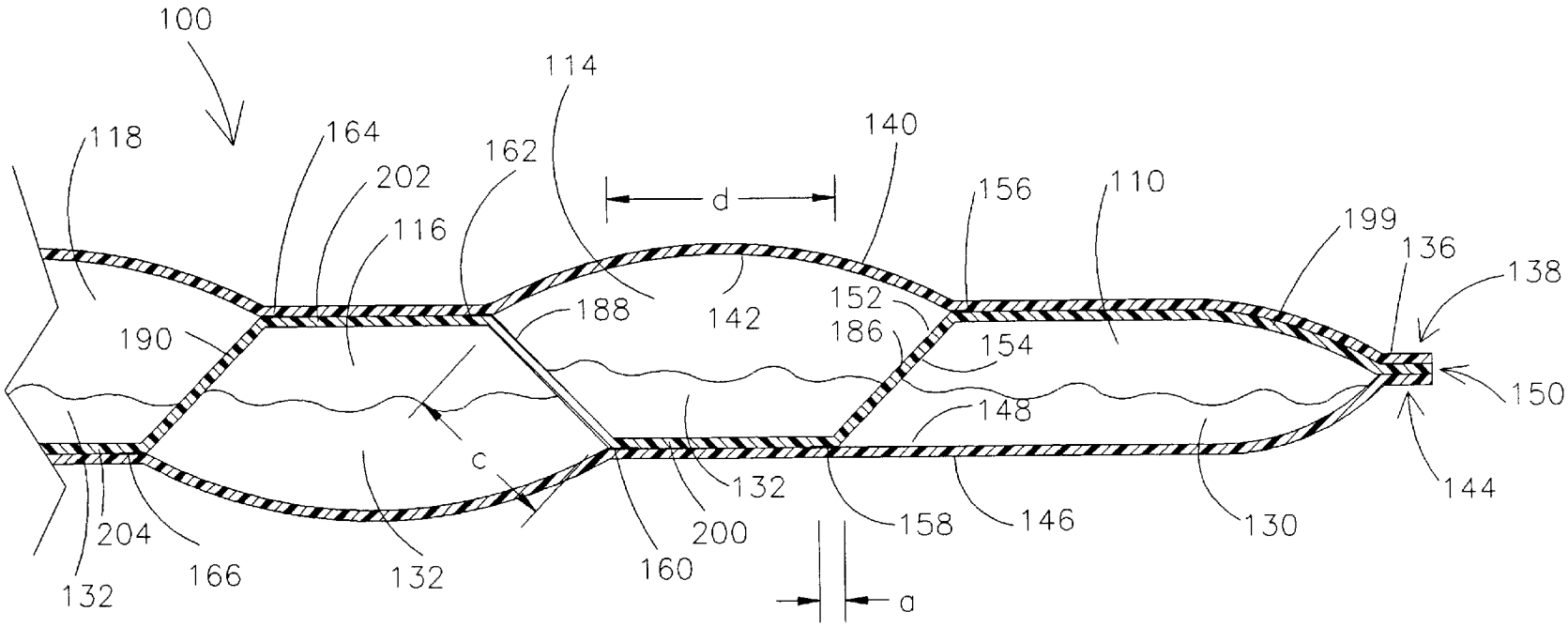
FIG. 4 is a cut-away cross-sectional view of the pressure pouch of FIG. 3 taken along the line 4—4 of FIG. 3.

FIGS. 3 and 4 illustrate a pouch 100 which may include a series of compartments containing components of an at least two-component gas generating system in a similar manner to the pouch 10 of FIGS. 1 and 2. Specifically, the pouch 100 may have a relatively large first compartment 110 and a plurality of secondary compartments 112, such as the secondary compartments 114, 116, 118, 120, 122, 124, 126 as shown. First compartment 110 may contain a quantity 130 of a first component of a two-component gas generating system, FIG. 4. The secondary compartments 112 may each contain a quantity 132 of the second component of the two component gas generating system. A triggering device 134, located in the compartment 110, may contain a quantity of the second component of the two-component gas generating system. The triggering device 134 and components 130, 132 may be of the type disclosed in U.S. Pat. Nos. 4,919,310 or 5,333,763, previously referenced, or may be of any other conventional type.

It is noted that, although FIG. 3 shows the pouch 100 in its completed configuration, the quantities 130, 132 of the gas generating components which would ordinarily be contained in the compartments 110 and 112 have been omitted for illustration purposes. The pouch 100 is illustrated in FIG. 3 in a collapsed configuration in which the compartments 110, 112 are empty. It is to be understood, however, that normally, the completed pouch 100 would contain quantities 130, 132 of the gas generating components as described above.

Referring to FIG. 4, it can be seen that the pouch 100 may be constructed of a first outer sheet 138, a second outer sheet 144 and an intermediate sheet 150. First outer sheet 138 may have an outer surface 140 and an inner surface 142. Second outer sheet 144 may have an outer surface 146 and an inner surface 148. Intermediate sheet 150 may have a first surface 152 and a second surface 154. The periphery 135, 136 of the pouch 100 may be formed in a conventional manner by forming a permanent heat seam between the three layers 138, 150, 144.

Intermediate sheet 150 is also connected to the outer sheets 138, 144 at a plurality of connection sites 155, such as the individual connection sites 156, 158, 160, 162, 164, 166, 168, 170, 172, 174, 176, 178, 180 and 182, FIG. 3. As best seen in FIG. 4, however, the intermediate sheet 150 is only connected to one of the outer sheets 138, 144 at each connection site 155. Specifically, at the connection sites 156, 162, 164, 170, 172, 178 and 180, the intermediate sheet 150 is connected only to the first outer sheet 138 and, at the connection sites 158, 160, 166, 168, 174, 176 and 182, the intermediate sheet 150 is connected only to the second outer sheet 144.

In this manner, the intermediate sheet 150 may form a plurality of frangible divider sections 184, such as the individual frangible divider sections 186, 188, 190, 192, 194, 196 and 198, FIG. 3, which divide the pouch 100 into the compartments 110, 112 as previously described. With reference to FIG. 4, it can be seen, for example, that the divider section 186 separates the compartment 110 from the compartment 114 and, thus, prevents mixing of the first component 130, located in the compartment 110, with the second component 132 located in the compartment 114. In a similar manner, the divider section 188 separates the compartment 114 from the compartment 116, the divider section 190 separates the compartment 116 from the compartment 118, and so on.

The divider sections 184 are frangible in the sense that they fail or tear when the internal strength of the material forming intermediate sheet 150 is exceeded. Each divider section may, thus, be formed from a continuous, integrally-formed section of the sheet 150. Each section remains intact in its continuous, integral configuration until sufficient force is generated to cause failure of the material forming intermediate sheet 150 and the particular divider section.

Each of the connection sites 155 comprises an area where the intermediate sheet 150 is bonded to either the first outer sheet 138 or second outer sheet 144. Specifically, at the connection sites 156, 162, 164, 170, 172, 178 and 180, the first surface 152 of intermediate sheet 150 is bonded to the inner surface 142 of first outer sheet 138. Similarly, at the connection sites 158, 160, 166, 168, 174, 176 and 182, the second surface 154 of intermediate sheet 150 is bonded to the inner surface 148 of second outer sheet 144.

Referring again to FIG. 4, it can be seen that an unattached section 200 of intermediate sheet 150 may be left between the connection sites 158 and 160. This unattached section of intermediate sheet 150 is not bonded to either of the outer sheets 138, 144. In a similar manner, an unattached section 199 may be left between the connection 156 and the pouch peripheral seam 136, an unattached section 202 may be left between the connections 162 and 164, an unattached section 204 may be left between the connections 166 and 168, and so on.

Pouch 100 may, for example, have an overall height "h" of about 18 inches and an overall length "l" of about 16 inches, FIG. 3. The connections 155 and compartments 112 defined thereby may have a height "b" of about 17.5 inches. The distance "d" from the outside of one connection site to the outside of the same connection site on the same sheet, may be about 0.75 inches, FIG. 4. Each of the connection sites 155 may have a width "a" of about 0.125 inches, FIG. 4. A pouch having dimensions as set forth above might be used, for example, in combination with a dispensing container having a volume of approximately ten liters. It is to be understood, however, that the pouch dimensions may readily be altered in order to accommodate other dispensing container sizes and configurations.

In operation, the pouch 100 is first typically inserted into a dispensing container containing a flowable material product in a conventional manner. After the container is sealed, the pouch triggering device 134 is activated, causing introduction of the second reactive component housed within the triggering device 134 to mix with the quantity 130 of first reactive component located in the compartment 110. The mixture of the first and second reactive components in this manner causes the generation of gas which, in turn, pressurizes the compartment 110 and the container. This pressure is used to force product from the container when it is desired to dispense product from the container.

As product is dispensed from the container, the volume of the compartment 110 increases. As can be appreciated with respect to FIG. 4, this increase in volume places the frangible divider section 186 in tension. As the volume of compartment 110 continues to increase, upon additional dispensing of product from the container, the tension in the frangible divider section 186 continues to increase until the divider section 186 fails.

Figure 5:
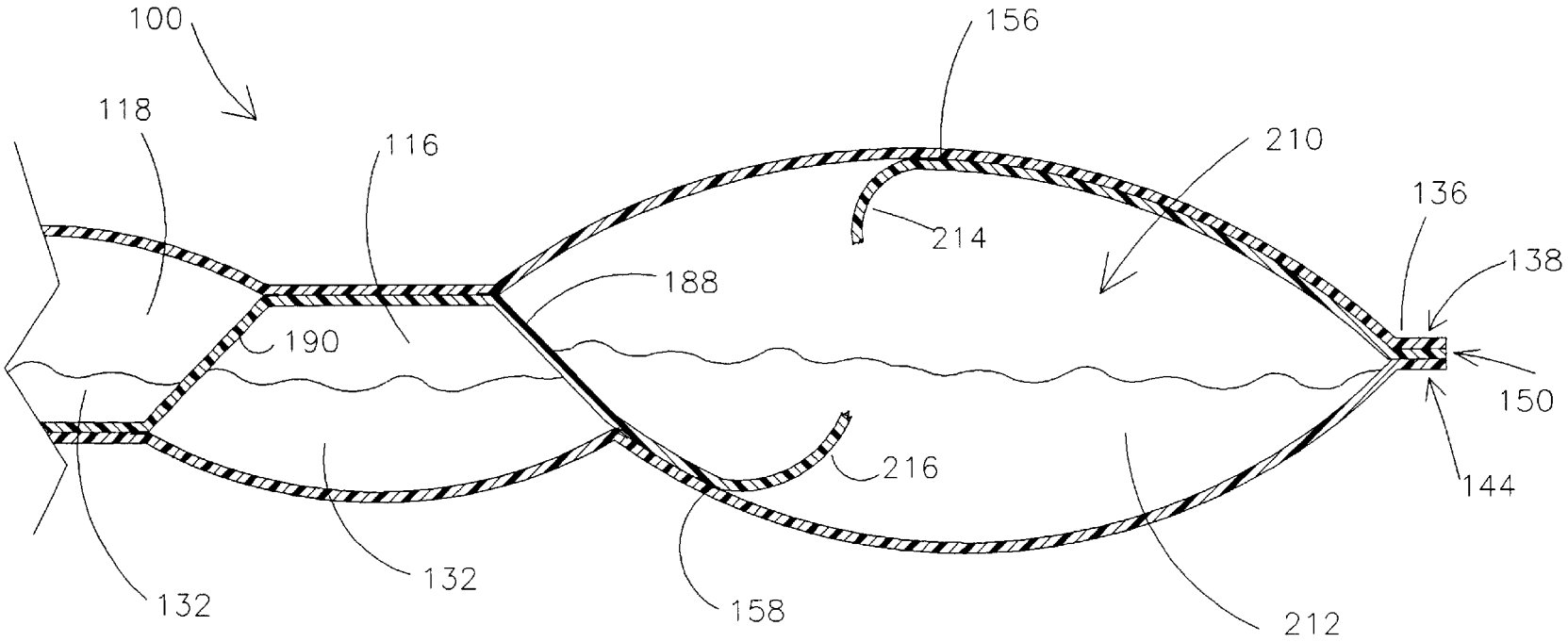
FIG. 5 is a view similar to FIG. 4 showing the pouch of FIG. 3 in a partially activated state.

FIG. 5 illustrates a portion of the pouch 100 after the first frangible divider section 186 has failed. As can be seen, a new compartment 210 has been formed which includes both of the original compartments 110 and 114. As can further be seen from FIG. 5, the frangible wall portion 186, FIG. 4, has separated into two segments 214, 216. First segment 214 remains attached to first outer sheet 138 by the connection 156 and second segment 216 remains attached to second outer sheet 144 by the connection 158.

New compartment 210 contains a mixture 212 of first component 130 previously contained in the first compartment 110 and the quantity 132 of second component previously contained in the secondary compartment 114. Mixing the first and second components in this manner causes more gas and pressure to be generated within the new compartment 210. As can be appreciated, as further product is dispensed, the volume of the new compartment 210 will increase, thus placing the frangible divider section 188 in increasing tension until it fails and allows the quantity 132 of second component located in secondary compartment 116 to mix with the quantity 212. This process continues with the frangible divider sections 190, 192, 194, 196 and 198 sequentially failing as more product is dispensed from the container.

The pressure profile generated by the pouch 110 will depend to a certain extent upon the tensile strength of the intermediate sheet 150 forming the frangible divider sections 184. Accordingly, the material used for intermediate sheet 150 must be carefully selected in order to provide the proper failure strength. If the failure strength is too high, the frangible divider sections 184 may open late, potentially causing unwanted pressure undulations in the container, or may completely fail to open, resulting in an inability to dispense product from the container. If, on the other hand, the failure strength is too low, the frangible divider sections 184 may open prematurely, potentially resulting in overpressurization of the container.

It has been found that good results may be obtained when intermediate sheet 150 is formed from a plastic sheet having a tensile strength of between about 2000 psi and 4000 psi, at yield, and a thickness of between about 0.00025 inches and about 0.003 inches. Preferably, intermediate sheet 150 may be formed from a plastic sheet having a tensile strength of about 3000 psi, at yield, and a thickness of between about 0.0005 inches and 0.001 inches. The plastic film used for the intermediate sheet 150 may be either a polypropylene or a polyethylene plastic film having a thickness lying within the ranges specified above. One such film which has been successfully tested is a polyethylene plastic film commercially available from Startex Company, Lakeville, Minn. 55044 and sold as Part No. 2925-01005.

Another factor impacting the pressure profile generated by the pouch 110 is the amount of elongation experienced by the frangible divider sections 184 prior to failure. Since intermediate sheet 150 is formed from a plastic material, some elongation will necessarily occur prior to failure. The amount of elongation that actually occurs will depend upon both the modulus of elasticity of the material used and upon the length "c" of the divider wall sections, FIGS. 3 and 4. As can be seen from FIGS. 3 and 4, this length "c" is defined by the distance between adjacent connection sites, such as the connection sites 156, 158, when the pouch is in its collapsed configuration.

Extreme elongation of the frangible divider sections 194 prior to failure may result in the formation of small holes or tears in the divider sections, rather than a clean break as illustrated in FIG. 5. Such small holes or tears may allow the passage of generated gas from one compartment to another but not allow passage of the liquid gas generating components and may, thus, result in a malfunctioning or partial malfunctioning of the pouch 100. It has also been found that reducing the elongation of the frangible divider sections prior to failure results in a more uniform, predictable pressure profile generated by the pouch 100 when activated.

In order to minimize elongation of the frangible divider sections 184 prior to failure, the length "c" of the divider sections may be minimized. In one example, the length "c" may be between about 0.1 inches and about 0.5 inches. Preferably the length "c", may be about 0.25 inches. Minimizing the length "c" also has another advantage in that the lengths of the first and second segments 214, 216 will also be reduced. It has been found that, if the segments 214, 216 are unduly long, the gas generating components located within the pouch may become trapped thereby, thus interfering with ideal operation of the pouch 100. Gas generating components might, for example, become trapped between the segment 216 and the second outer sheet 144, as shown in FIG. 5, if the segment 216 were too long.

Because the pouch 100 contains no peelable seams, the outer sheets 138, 144 may be of a much simpler and less expensive configuration than was possible with prior art pressure pouches. Outer sheets 138, 144 may, for example, have a thickness of between about 0.003 inches and about 0.005 inches and may be formed from a laminate of two layers.

The outer layer, forming the pouch outer surfaces 140, 146, FIG. 4, may be a PVDC-coated polyester, chosen to be flavor compatible and/or non-reactive with the product to be dispensed from the container and also chosen to be capable of providing sufficient gas impermeability in order to prevent the migration of gas from within the pouch 100 into the product being dispensed from the container. One such material for forming the outer layer, which has been successfully tested, is commercially available from DuPont Corporation, and sold under the trade designation "M44".

The inner layer, forming the pouch inner surfaces 142, 148, FIG. 4, may be a heat sealable thermal plastic such as polyethylene which is amenable to forming permanent heat seams in a conventional manner.

When constructing the pouch 100, the connection sites may be formed in any conventional manner. The connection sites may, for example, be formed by gluing the intermediate sheet 150 to the appropriate outer sheet 138, 144 at the desired connection site locations. In a preferred method of forming the pouch 100, however, the connection sites 100 may be formed by a heat seaming or sealing process, similar to that conventionally used to form the outer peripheral seams 135, 136 of the pouch 100 and the outer peripheral seams 39, 40 of the prior art pouch 10. In the preferred heat seaming method, both the seams forming the periphery 135, 136 of the pouch 100 as well as the connection sites 155, FIG. 3, may be created by forming permanent heat seams between the relevant sheet layers. These seams may be formed with a conventional heat sealing machine in which a platen is provided having a plurality of heat bars positioned in locations corresponding to the locations where heat seams are desired.

Figure 6:
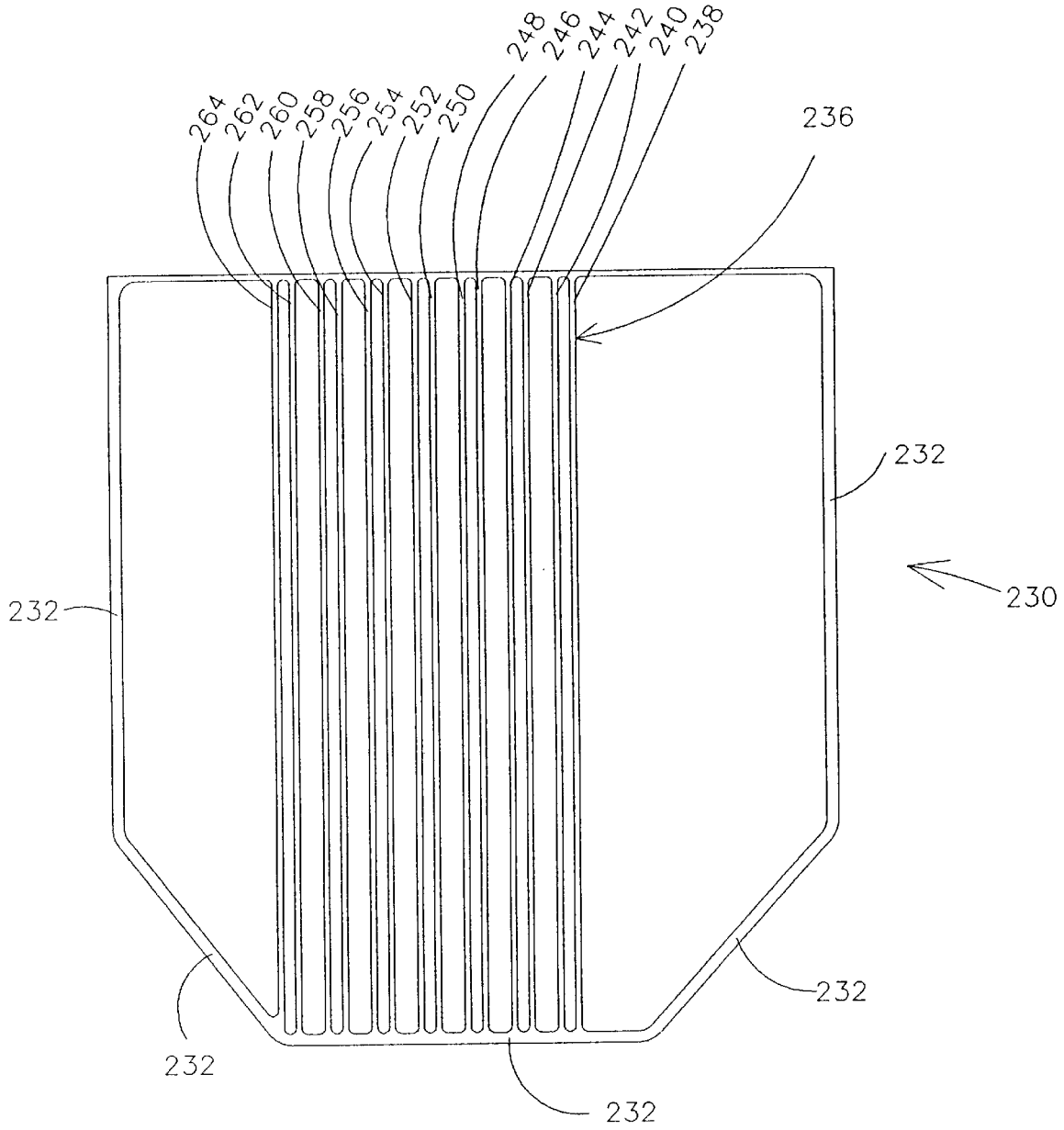
FIG. 6 is a top plan view of a portion of machine tooling used to manufacture the pouch of FIG. 3.

An example of such a platen is illustrated in FIG. 6. Referring to FIG. 6, a top platen 230 may be provided having a plurality of peripheral upraised heat bars 232 located thereon. Heat bars 232 are used to form the pouch lower periphery seam area 136, FIG. 3. Platen 230 may also be provided with a plurality of secondary upraised heat bars 236, such as the individual secondary heat bars 238, 240, 242, 244, 246, 248, 250, 252, 254, 256, 258, 260, 262 and 264. The secondary heat bars 236 are used to form the connection sites 155, FIG. 3, with each individual secondary heat bar 238, 240, 242, 244, 246, 248, 250, 252, 254, 256, 258, 260, 262 and 264 corresponding in size, shape and location to the individual connection sites 182, 180, 178, 176, 174, 172, 170, 168, 166, 164, 162, 160, 158 and 156, respectively.

Platen 230 may represent the top plate of a heat sealing machine. A lower plate 231, FIG. 8, may be formed as a solid plate member which may have an elastomeric coating for contacting the second outer sheet outer surface 146 in a conventional manner. Lower plate 231, thus, cooperates with the top platen 230 to form the heat seals as previously described.

Figure 7:
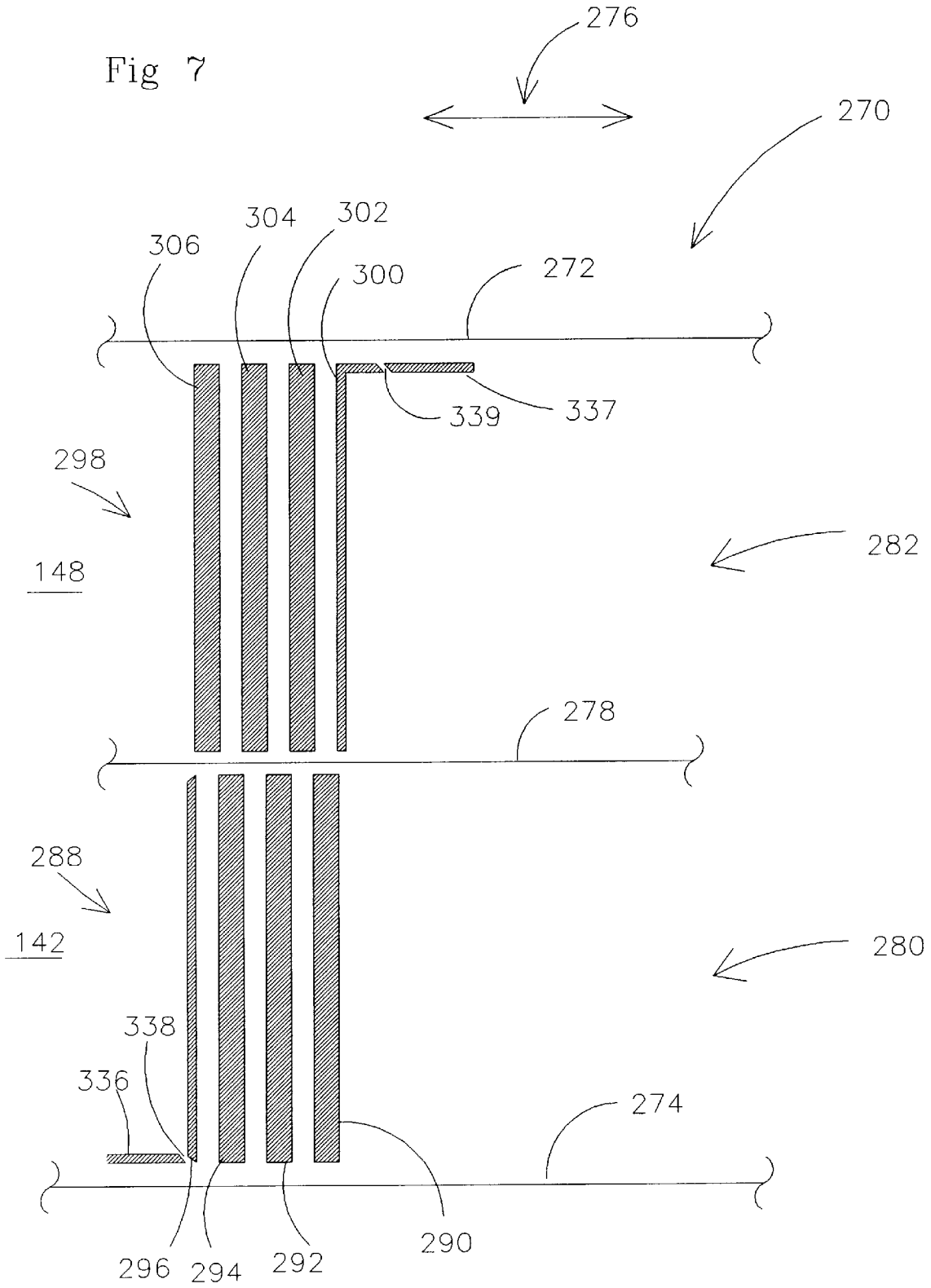
FIG. 7 is a top plan view of a web of material from which the pouch of FIG. 3 may be manufactured.

FIG. 7 shows a portion of a web 270 of plastic material, of the type from which the pouch outer sheets 138, 144 are formed. Web 270 has lateral edges 272, 274 and extends in a longitudinal direction indicated by the arrow 276. The web 270 has a longitudinal centerline 278, generally centered between the web edges 272, 274. Centerline 278 divides the web 270 into a first, lower half 280 and a second, upper half 282. To form the pouch 100, the web 270 may be folded along its centerline 278 so that the first, lower web half 280 overlies the second, upper web half 282. The intermediate sheet 150, FIGS. 3,4, may be inserted between the web halves 280, 282, and the heat sealing device previously described may then be used to supply heat in selected areas to form the lower peripheral pouch seams 136 and the connection sites 155.

In this manner, the first, lower web half 280 becomes the pouch first outer sheet 138 and the second, upper web half 282 becomes the pouch second outer sheet 144, FIG. 4. Because the intermediate sheet 150 is attached to only one of the outer sheets 138, 144 at a given connection site 155, a mechanism must be employed to prevent attachment of the intermediate sheet in selected areas. Referring to FIG. 4, it can be seen, for example, that, at the connection site 156, the intermediate sheet 150 is connected only to the first outer sheet inner surface 142 and not to the second outer sheet inner surface 148. At the adjacent connection site 158, however, the intermediate sheet 150 is attached only to the second outer sheet inner surface 148 and not to the first outer sheet inner surface 142.

Figure 8:
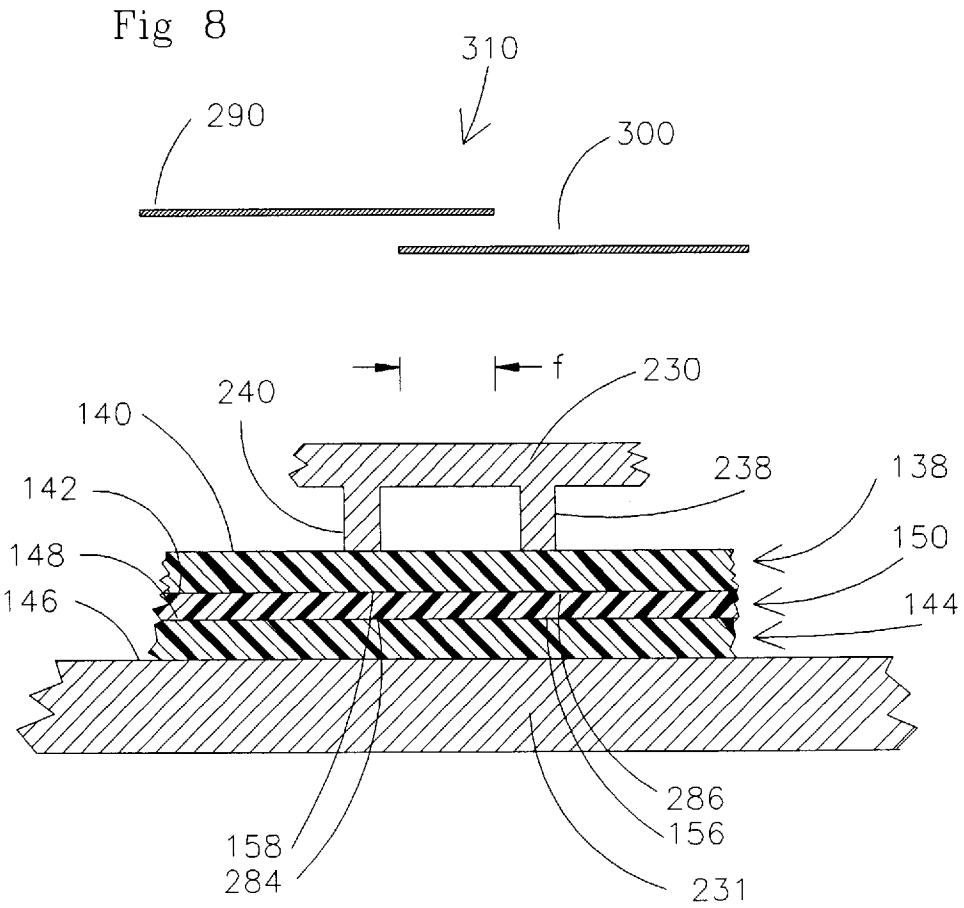
FIG. 8 is a detail cross-section view of a portion of the machine of FIG. 6.

FIG. 8 illustrates a portion of the heat sealing machine top platen 230 and lower plate 231 being used to form the connection sites 156, 158 in the pouch 100. As can be seen, top platen secondary heat bar 240 supplies heat to form the connection 158 between intermediate sheet 150 and second outer sheet 144. As can be appreciated, a mechanism must be employed to prevent an undesirable attachment of the intermediate sheet 150 to the first outer sheet 138 at the location 284 as shown. In a similar manner, top platen secondary heat bar 238 supplies heat to form the connection 156 between intermediate sheet 150 and first outer sheet 138. A mechanism must also be employed to prevent an undesirable attachment of the intermediate sheet 150 to the second outer sheet 144 at the location 286.

Referring again to FIG. 7, it can be seen that the mechanism described above may comprise a plurality of heat sealing disruptive strips 288, 298 provided on the web 270. Specifically, strips 288, such as the individual strips 290, 292, 294 and 296 may be provided on the upper surface of the web first, lower half 280, that is, the surface which will become pouch first outer sheet inner surface 142 when the pouch 100 is formed. In a similar manner, strips 298, such as the individual strips 300, 302, 304 and 306 may be provided on the upper surface of the web second, upper half 282, that is, the surface which will become pouch second outer sheet inner surface 148 when the pouch 100 is formed.

Figure 9:
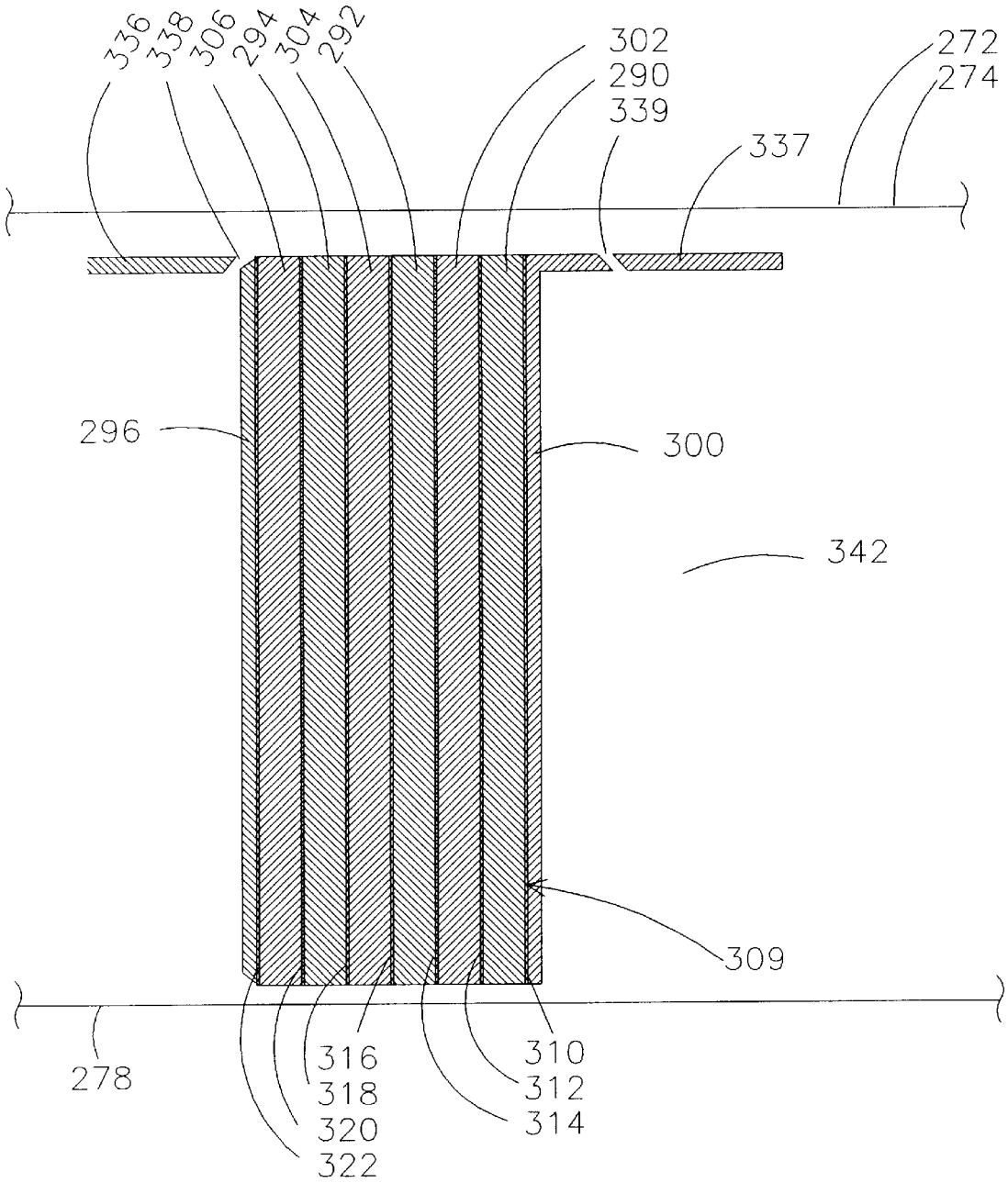
FIG. 9 is a top plan view of the web of FIG. 7 in a folded configuration.

FIG. 9 shows the web 270 after it has been folded at centerline 278 as previously described. As can be seen, the configuration of the strips 288, 298 on the web 270 is such that the strips 288 alternate with the strips 298 when the web is folded as shown in FIG. 9. As can further be seen from FIG. 9, adjacent strips may overlap with each other to form overlap regions generally indicated by reference numeral 309. Specifically, strips 300 and 290 may form an overlap area 310, strips 290 and 302 may form an overlap area 312, strips 302 and 292 may form an overlap area 314, strips 292 and 304 may form an overlap area 316, strips 304 and 294 may form an overlap area 318, strips 294 and 306 may form an overlap area 320 and strips 306 and 296 may form an overlap area 322.

FIG. 8 schematically illustrates the location of the strips 290 and 300 and the overlap area 310 therebetween with respect to the heat sealing machine heat bars 238, 240 and the pouch connection sites 156, 158 when the heat sealing machine is forming the connection sites 156 and 158. Each overlap area 309 may be generally centered between adjacent secondary heat bars 236 as illustrated, for example, by the overlap area 310 being generally centered between the heat bars 238 and 240 in FIG. 8. The overlap areas 309 may each have a width "f" of between about 0 inches and about 0.25 inches as illustrated, for example, with respect to the overlap area 310 in FIG. 8. Preferably, the overlap areas 309 may each have a width "f" of about 0.0625 inches.

With further reference to FIG. 8, it can be appreciated that the heat seam disruptive strip 300, which is located between the second outer sheet 144 and the intermediate sheet 150, will prevent the second outer sheet 144 from becoming attached to the intermediate sheet 150 at the location 286 when the seam 156 is created. In a similar manner, it can be appreciated that the heat seam disruptive strip 290, which is located between the first outer sheet 138 and the intermediate sheet 150, will prevent the first outer sheet 138 from becoming attached to the intermediate sheet 150 at the location 284 when the seam 158 is created. In this manner, the pouch connection sites 155 may all be formed as previously described.

As an alternative to using a heat sealing machine platen 230 having upraised secondary heat bars 236, FIG. 6, the platen may be constructed as a continuous heating surface. Such a platen will bond all areas of the pouch 100 where the disruptive strips 288, 298 are not present. The use of such a platen will result in a pouch identical to the pouch 100 previously described, except that the unattached sections, e.g., 199, 200, 202, 204, FIG. 4, will be attached to their respective outer sheets 138, 144. Section 199, for example, will be attached to the first outer sheet 138, section 200 will be attached to second outer sheet 144, section 202 will be attached to first outer sheet 144, section 204 will be attached to second outer sheet 144, and so on.

The heat seam disruptive strips 288, 298 must be capable of transmitting heat and yet must also be capable of preventing the formation of seams. With respect to FIG. 8, for example, it can be appreciated that the heat seam disruptive strip 290 must be capable of transmitting heat supplied by the heat bar 240 to the connection site location 158. The strip 290 must also, however, be able to prevent or disrupt the formation of a seam at the location 284.

As can be seen from FIGS. 7 and 9, strip 300 may include an extension area 337 and strip 296 may include an extension area 336. With reference to FIG. 9, it can be seen that, when the web 270 is folded, the extension areas 336, 337 extend along the top of the pouch configuration. The extension areas 336, 337 serve to prevent the top portion of the outer areas 341, 342 from becoming sealed when the heat sealing device is used to form the connections 155 and lower peripheral seams 136. It is necessary to keep these top portions open so that the outer compartments 110, 126 can be filled with reactive components. As can further be seen from FIGS. 7 and 9, gaps 338 and 339 may also be provided in the strip extension areas 336, 337. The purpose of these gaps is to allow upper peripheral seams 135 to be formed after the pouch compartments have been filled, as will be explained in further detail herein.

After the web 270 is folded as shown in FIG. 9 and intermediate sheet 150 is inserted, as previously described, the heat sealing machine may be used to form the lower peripheral seams 136 and the connection sites 155. Because both the peripheral seams 136 and the connection sites 155 are formed as permanent seams, approximately the same temperature may be used to form both the peripheral seams 135 and the connection site seams 155. In one example, the temperature used to form these seams may be between about 250 and about 380 degrees, F.

As an alternative to using a single web 270 in the method described above, the web lower and upper halves 280, 282 may be formed as two separate webs. After providing the heat seam disruptive strips 288, 298 on the two webs, the webs may then be aligned so that the strips 288, 298 are in the configuration previously described with respect to FIG. 9.

It has been found that various materials, applied to the upper surface 142, 148 of the web 270, will function adequately as heat seam disruptive strips as described above. Examples include adhesive tape, paper, silicone oil and various waxes. In a preferred embodiment, however, the heat seam disruptive strips may comprise an ink which may be printed onto the upper surface 142, 148 of the web 270 in a pattern such as that shown in FIG. 7. The ink used may be an ink which is commercially available from Sun Chemical Company and sold as catalog number SLD 533F #287 Blue.

As an alternative to the use of heat seam disruptive strips 288, 298, the formation of the seams 155 may be selectively formed in any conventional manner. The seams may, for example, be selectively formed by placing a mechanical device in the appropriate areas during the seaming process in order to prevent a seam from occurring. The mechanical device may then be removed after the seaming step is completed.

Figure 10:
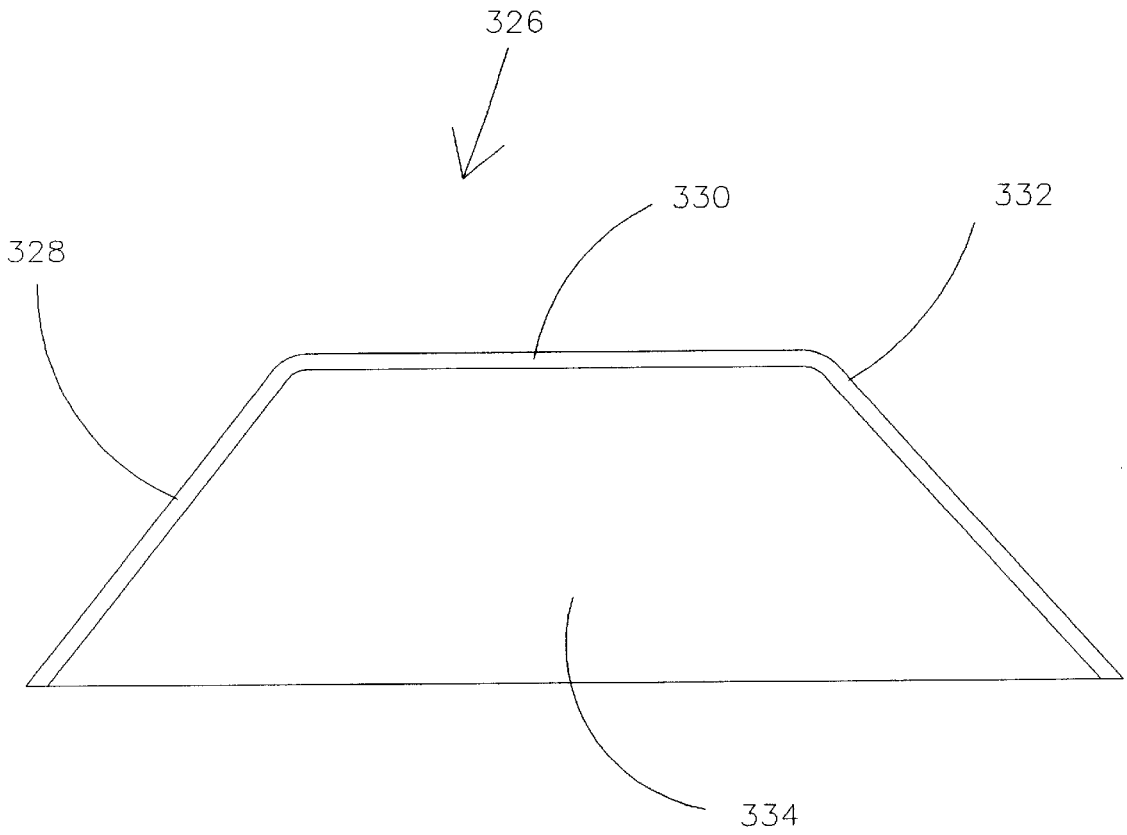
FIG. 10 is a top plan view of a portion of the machine of FIG. 6.

After the lower peripheral seam 136 and the connection site seams 155 are formed, the pouch compartments 110, 112 may be filled with reactive components in a conventional manner through the top portion of the pouch which has been left open for this purpose. After filling and inserting the trigger device 134, the upper pouch peripheral seam 135 may be formed using a heat sealing device 326 as generally illustrated in FIG. 10 in a conventional manner. Heat sealing device 326 may comprise a platen 334 to which are attached raised heat bar portions 328, 330, 332 which may correspond to the shape, size and location of the pouch upper peripheral seam 135, FIG. 3. After forming the upper peripheral seam 135 and trimming excess material from the pouch, the pouch will be of the configuration shown in FIG. 3. At this point, the pouch 100 is sealed and ready for use for dispensing product from a container.

When a heat sealing method as described above is used, one important requirement of the film forming intermediate sheet 150 is that it be capable of forming permanent heat sealed seams with the outer sheets 138, 144 which are stronger than the tensile strength of the film 150. If the tensile strength of the film 150 were higher than the weld strength, the welds would merely fail before failure of the intermediate sheet frangible divider sections, thus resulting in malfunctioning of the pouch 100.

As can be appreciated from the foregoing description, the pouch 100 requires no peelable seams and thus avoids the problems associated with peelable seams. The pouch 100, for example, allows the use of less expensive and less complex plastic film for the pouch outer layers 138, 144. The pouch 100 also allows the use of a simpler and more reliable manufacturing method.

It is noted that the pouch 100 has been described herein having a particular configuration only for illustrative purposes. In practice, the frangible divider sections 184 may be used with a pouch of any size having virtually any number and configuration of compartments as required for a particular application.

Figure 11:
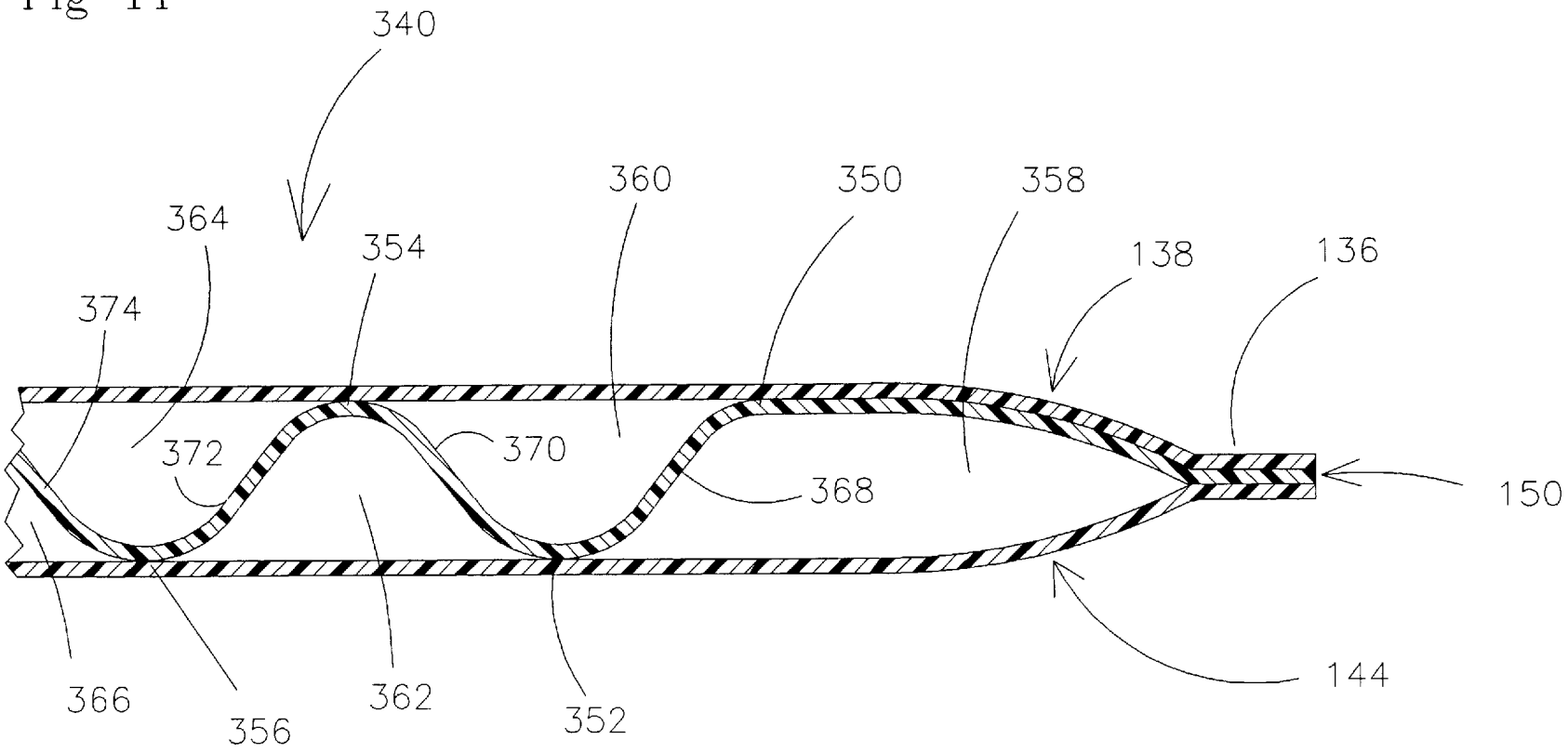
FIG. 11 is a cut-away cross-sectional view of an alternative embodiment of a pressure pouch.

FIG. 11 shows a pouch 340 in which the connections, e.g. 350, 352, 354, 356, between intermediate sheet 150 alternate between the first outer sheet 138 and the second outer sheet 144 on every connection. Specifically, as can be seen, the connection 350 connects the intermediate sheet 150 to the first outer sheet 138. The adjacent connection 352 connects the intermediate sheet 150 to the second outer sheet 144. The next adjacent connection 354 connects the intermediate sheet 150 to the first outer sheet 138, and so on.

This configuration of the pouch 340 results in a plurality of compartments, e.g. 358, 360, 362 and 364 being formed in the pouch 100. The compartments are separated from one another by a plurality of frangible divider sections, e.g. 368, 370, 372 and 374 which are formed from the intermediate sheet 150. Specifically, the compartments 358 and 360 are separated by the frangible divider section 368, the compartments 360 and 362 are separated by the frangible divider section 370, the compartments 362 and 364 are separated by the frangible divider section 372, and so on.

Pouch 340 may operate in substantially the same manner as previously described with respect to FIGS. 3–10. The pouch 340, however, is generally simpler to manufacture than the pouch 100 previously described. It is noted, however, that the design of the pouch 340 results in relatively longer divider wall sections, e.g., 368, 370, 372, 374, and, thus, a greater elastic deformation of the divider wall sections before failure occurs. Although, as previously discussed, such increased deformation is generally undesirable, the design of pouch 340 may, nevertheless, be adequate for some applications. The pouch 340 may be manufactured according to any of the manufacturing methods previously described.

In a similar manner to the pouch 100 of FIGS. 3–5, the divider sections, e.g. 368 370, 372, 374 are frangible in the sense that they fail or tear when the internal strength of the material forming intermediate sheet 150 is exceeded. Each divider section may, thus, be formed from a continuous, integrally-formed section of the sheet 150. Each section remains intact in its continuous, integral configuration until sufficient force is generated to cause failure of the material forming intermediate sheet 150 and the particular divider section.

Figure 12:
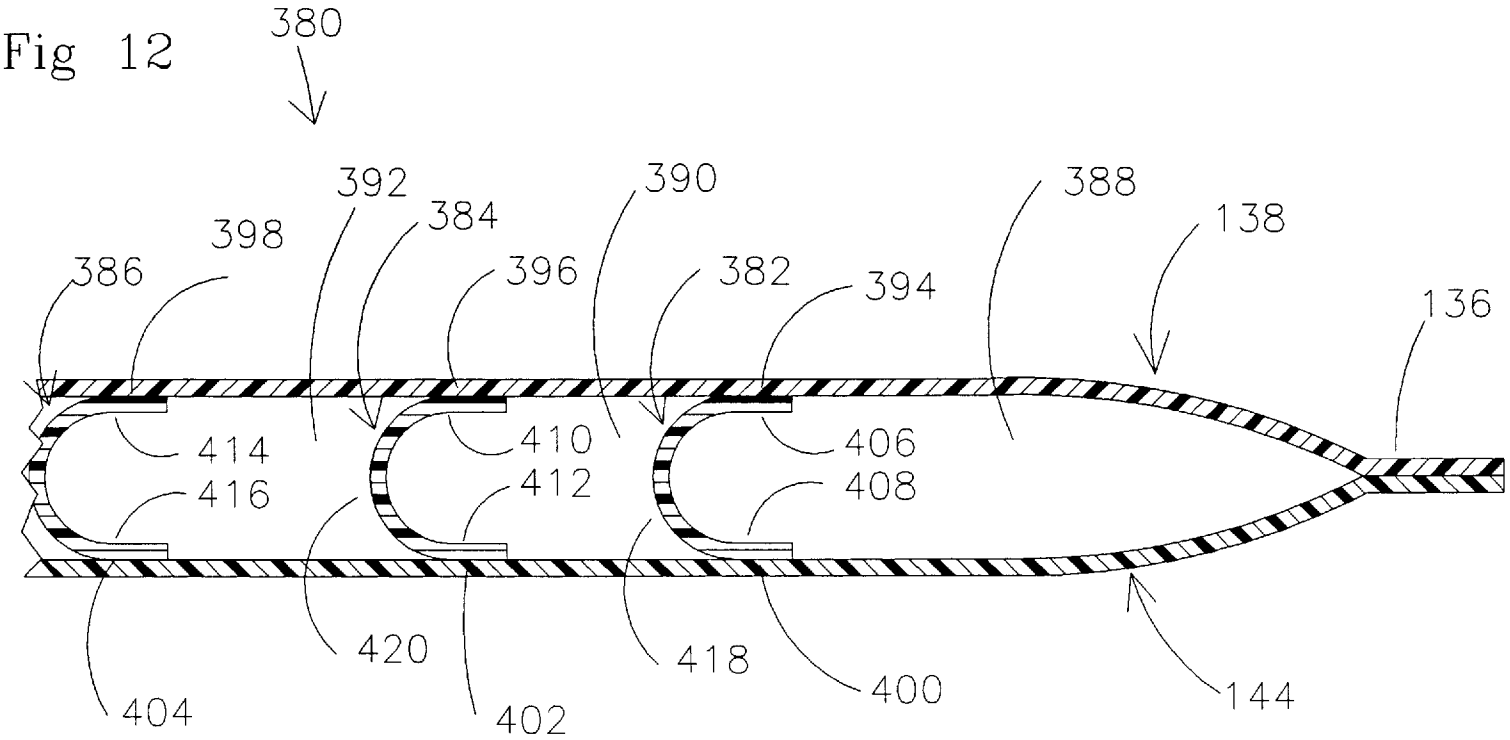
FIG. 12 is a cut-away cross-sectional view of another alternative embodiment of a pressure pouch.

FIG. 12 illustrates a pouch 380 in which a plurality of discreet frangible divider sections, e.g., 382, 384, 386, divide the pouch 380 into compartments, such as the compartments 388, 390 and 392. Specifically, the divider section 382 separates the compartment 388 from the compartment 390, the divider section 384 separates the compartment 390 from the compartment 392, and so on. Each divider section 382, 384, 386 may be attached to the pouch first outer sheet 138 at a plurality of connection sites 394, 396, 398, respectively, as shown. Each of the divider sections 382, 384, 386 may also be attached to the pouch second outer sheet 144 at a plurality of connection sites 400, 402, 404, respectively.

The connections 394, 396, 398, 400, 402, 404 may be made according to any of the methods previously described. If a heat sealing method is employed, heat sealing disruptive strips may be applied to either or both of the surfaces 406, 408 of the divider section 382 in order to prevent the divider section 382 from bonding to itself at these locations. The remaining divider sections, e.g., 396, 398 may also be provided with heat sealing disruptive strips at either or both of the locations 410, 412 and 414, 416, respectively. As an alternative to disruptive strips, a mechanical seam blocking method may be employed as previously described.

The pouch 380 may operate in a similar manner to the pouch 100 previously described, that is expanding volume in one compartment causes failure of section and the add section and the addition of gas generating component contained in an adjacent compartment. For example, in the pouch 380, an expansion in volume of the compartment 388 will result in failure of the frangible divider section 382 and thus allow the component contained in the compartment 390 to mix with the contents of the compartment 388, thus allowing the gas generating reaction to continue.

In a similar manner to the pouch 100 of FIGS. 3–5, the divider sections, e.g., 382, 384, 386, of the pouch 380 are frangible in the sense that they fail or tear when the internal strength of the material forming the divider sections is exceeded. Each divider section may, thus, be formed from a continuous, integrally-formed sheet of plastic material. Each divider section remains intact in its continuous, integral configuration until sufficient force is generated to cause failure of the material forming the divider section.

Alternatively, to facilitate reliable failure, the pouch 380 frangible divider sections, e.g., 382, 384, 386, may be provided with weakened areas. Divider sections 382 and 384, for example, may be provided with weakened areas 418, 420, respectively. These weakened areas may aid in more reliable failure of the divider wall portions and, thus, contribute to more reliable and predictable operation of the pouch 380.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. An improved pressure pouch suited for use in combination with a dispensing container, said pressure pouch having at least first and second compartments and containing components of an at least two-component gas generating system, wherein the improvement comprises:

a first sheet of a flexible material, said first sheet having an outer surface and an oppositely disposed inner surface;

a second sheet of a flexible material, said second sheet having an outer surface and an oppositely disposed inner surface;

a third sheet of flexible material located between at least portions of said first and second sheets;

said third sheet being sealed to said first sheet inner surface at a first location and to said second sheet inner surface at a second location;

wherein said third sheet forms a first divider wall portion located between said first location and said second location; and wherein said first divider wall portion forms a common wall between said at least first and second compartments.

2. The pressure pouch of claim 1 wherein said first divider wall portion is a frangible divider wall portion.

3. The pressure pouch of claim 1 further including:

a third compartment containing at least one component of said at least two-component gas generating system;

said third sheet being sealed to said first sheet inner surface at a third location;

wherein said third sheet forms a second divider wall portion located between said second location and said third location; and wherein said second divider wall portion forms a common wall between said second and third compartments.

4. The pressure pouch of claim 1 further including:

a third compartment containing at least one component of said at least two-component gas generating system;

said third sheet being sealed to said second sheet inner surface at a third location and to said first sheet inner surface at a fourth location;

wherein said third sheet forms a second divider wall portion located between said third location and said fourth location; and wherein said second divider wall portion forms a common wall between said second and third compartments.

5. The pressure pouch of claim 3 wherein said first and second divider wall portions are frangible divider wall portions.

6. The pressure pouch of claim 4 wherein said first and second divider wall portions are frangible divider wall portions.

7. An improved pressure system suited for use in combination with a dispensing container, wherein the improvement comprises:

a pouch having a first compartment containing at least a first component of an at least two-component gas generating system;

a second compartment containing at least a second component of said at least two-component gas generating system; and a first frangible wall portion separating said first and second compartments.

8. The pressure system of claim 7 wherein said pouch includes a third compartment separated from said second compartment by a second frangible wall portion.

9. The pressure system of claim 8 wherein said third compartment contains at least said second component of said at least two-component gas generating system.

10. The pressure system of claim 9 wherein said first compartment is adjacent said second compartment.

11. The pressure system of claim 7 wherein said first frangible wall portion is formed from either a polypropylene or a polyethylene plastic sheet.

12. The pressure system of claim 8 wherein said first and second frangible wall portions are formed from a single sheet of plastic material.

13. The pressure system of claim 8 wherein said first frangible wall portion is formed from a first plastic sheet and said second frangible wall portion is formed from a second plastic sheet which is separate from said first plastic sheet.

14. A method of making an improved pressure pouch having at least first and second compartments and containing at least first and second components of an at least two-component gas generating system, comprising the steps of:

providing a first sheet of a flexible material, said first sheet having an outer surface and an oppositely disposed inner surface;

providing a second sheet of a flexible material, said second sheet having an outer surface and an oppositely disposed inner surface;

locating a third sheet of flexible material between at least portions of said first and second sheets;

creating a first divider wall between said at least first and second compartments by attaching said third sheet to said first sheet inner surface at a first location and to said second sheet inner surface at a second location.

15. The method of claim 14 including the further step of selecting a membrane of material for said third sheet having a preselected tensile strength.

16. The method of claim 14 including the further steps of placing at least said first component in said first compartment and placing at least said second component in said second compartment.

17. The method of claim 14 including the further steps of:

providing at least a third compartment in said pressure pouch;

creating a third divider wall between said second compartment and said third compartment by attaching said third sheet to said first sheet inner surface at a third location.

18. The method of claim 14 including the further steps of:

providing at least a third compartment in said pressure pouch;

creating a third divider wall between said second compartment and said third compartment by attaching said third sheet to said second sheet at a third location and to said first sheet at a fourth location.

19. The method of claim 14 wherein said step of attaching said third sheet to said first sheet inner surface at a first location is accomplished by heat seaming said third sheet to said first sheet inner surface at said first location.

20. The method of claim 19 including the further step of applying a heat seam blocking compound to at least a portion of said second sheet inner surface.

* * * * *

UNITED STATES PATENT AND TRADEMARK OFFICE

CERTIFICATE OF CORRECTION

PATENT NO. : 5,769,282
DATED : June 23, 1998
INVENTOR(S) : Lane et al.

It is certified that error appears in the above-identified patent and that said Letters Patent is hereby corrected as shown below:

In column 8, line 45, after "c" delete --,--.

In column 13, line 58 after "of" insert --a frangible divider--.

In column 13, line 58 delete "and the add"

In column 13, line 59, delete --section--.

Signed and Sealed this

Sixth Day of October, 1998

*Attest:*

*Attesting Officer*

Bruce Lehman

BRUCE LEHMAN

*Commissioner of Patents and Trademarks*